US005704604A

United States Patent [19]

Koelle et al.

[11] Patent Number: 5,704,604

[45] Date of Patent: Jan. 6, 1998

[54] PROCESS AND DEVICE FOR FORMING AND TRANSFERRING STACKS OF PRINTED SHEETS

[75] Inventors: Helmut Koelle; Bertold Mader; Gerhard Winterstein, all of Augsburg, Germany

[73] Assignee: Böwe Systec AG, Augsburg, Germany

[21] Appl. No.: 619,481

[22] PCT Filed: Sep. 24, 1994

[86] PCT No.: PCT/EP94/03192

§ 371 Date: Mar. 18, 1996

§ 102(e) Date: Mar. 18, 1996

[87] PCT Pub. No.: WO95/09796

PCT Pub. Date: Apr. 13, 1995

[30] Foreign Application Priority Data

Oct. 1, 1993 [DE] Germany ..... 43 33 575.6

[51] Int. Cl.[6] ..... B65H 39/00

[52] U.S. Cl. ..... 270/52.09; 270/52.07

[58] Field of Search ..... 270/52.07, 52.09; 271/182

[56] References Cited

U.S. PATENT DOCUMENTS

| | | | |
|---|---|---|---|
| 3,026,107 | 3/1962 | Stroud . | |
| 3,370,843 | 2/1968 | Woodside | 270/52.09 X |
| 4,265,443 | 5/1981 | Berthelot | 271/182 |
| 4,719,855 | 1/1988 | Cannon et al. | 101/426 |
| 4,939,888 | 7/1990 | Katz et al. | 270/52.09 X |
| 4,944,503 | 7/1990 | Arima | 270/52.09 |

FOREIGN PATENT DOCUMENTS

| | | |
|---|---|---|
| 1425194 | 12/1965 | France . |
| 1 085 409 | 7/1960 | Germany . |
| 21 876 | 9/1961 | Germany . |
| 1 436 485 | 2/1969 | Germany . |
| 24 34 460 | 3/1975 | Germany . |
| 29 43 094 | 5/1980 | Germany . |
| 87 15 359 | 3/1988 | Germany . |
| 3801529 | 8/1988 | Germany . |
| 418 366 | 8/1966 | Switzerland . |
| 2025372 | 1/1980 | United Kingdom . |
| 9315006 | 8/1993 | WIPO . |

*Primary Examiner*—Hoang Nguyen
*Attorney, Agent, or Firm*—McGlew And Tuttle

[57] ABSTRACT

The present invention pertains to a process and a device for forming stacks from printed documents or other sheets 9. The sheets 9 are either moved forward individually or are separated from a web 2 of printed sheets by tearing or cutting, and they are arranged in a stream one on top of another such that the next sheet 9 comes to lie offset under the preceding sheet 9. The stack 10 is formed by the sheets 9 arranged in a stream coming into contact with a stop 11. To lose little time during the transfer of a finished stack 10 of sheets, a gap 25 is formed between the last sheet 9 belonging to the stack 10 and the next sheet before the sheets 9 are arranged in a stream. As soon as the last sheet 9 has reached the stacking position, the stop 11 is removed from its stop position, so that the stack 10 is moved away from the belt conveyor 20. The stop 11 is then returned into its stop position, and the next stack 10 is formed.

18 Claims, 3 Drawing Sheets

5
14
6
17
16
15
18
9
25
24
25
24
19
4
22
10
11
20
21
7
16
19
15
6
28
27
5
2

PROCESS AND DEVICE FOR FORMING AND TRANSFERRING STACKS OF PRINTED SHEETS

FIELD OF THE INVENTION

The present invention pertains to processes and devices for forming and transferring stacks of printed sheets, in which the sheets are arranged in a stream and stacked, sheet groups arranged in a descending stream, between which a gap is located, are delivered to a stop at which the stack is formed from bottom to top, wherein the stop is briefly removed from a stop position to release and remove the stack using an automatic sequence control, depending on a position of the gap located between the groups of sheets.

BACKGROUND OF THE INVENTION

Such an arrangement has become known from DE-A-1 436 485. That document pertains to the delivery, counting, and stacking of documents to form stacks containing a constant, predetermined number of documents. The individual documents are first arranged in an ascending stream. Arranging in an ascending stream means that the front edge of the next document comes to lie over the rear edge of the preceding document.

When documents thus arranged in a stream come into contact with a stop for forming a stack, the stack is formed from top to bottom, which has some disadvantages. It is therefore desirable to form the stack from the bottom to the top. This object is achieved by the prior-art arrangement according to DE-A-1 436 485 by turning documents arranged in an ascending stream by 180° over a drum and feeding them thus to the stop. This measure has an extremely high space requirement and is extremely expensive.

In addition, it has been known from DE-A-1 436 485 that a gap between two adjacent documents can be formed with a rake engaging the documents arranged in a stream, and this gap is then scanned by a control member in order to stack only the group of sheets located between the gaps. This arrangement leads to the counting of a predetermined number of sheets and consequently to the formation of a stack of sheets of equal height.

In contrast, the present invention pertains to a problem that differs from the state of the art.

It is required in the area of modern data processing that data, information or the like, printed on individual sheets or on endless webs, be prepared in a ready-to-ship form by separating individual sheets from the web of sheets and to stack them. A special problem arises now due to the requirement of stacking only sheets belonging to a certain group, of subsequently transferring the stack, and of forming a new stack or another group of sheets. In the case of data storage media, which are to be stacked in a given order such that the first sheet will lie on top, it becomes necessary to form the stack from the bottom to the top.

However, such a measure has been known from DE-A-1 436 485 only in such a way that stacks containing equal numbers of documents are formed.

However, it is important in connection with the processing of documents to form stacks of different heights, depending on how many documents must be assigned to the individual process.

SUMMARY AND OBJECTS OF THE INVENTION

The primary object of the present invention is therefore to improve the above-mentioned prior-art measures such that it is possible to stack and further process groups of documents containing different numbers of documents. Whether the documents are fed in as individual cut sheets or they must be separated from a web of documents is left open.

The groups of sheets are subsequently separated before the sheets are arranged in a stream. This measure offers the advantage that the control of stack formation is also initiated with a simple automatic sequence control along with the separation of the groups of sheets.

If individual sheets are printed, the separation of groups of sheets can be performed with an arrangement according to DE-A-1 436 485, but with the difference that sheets arriving one behind the other rather than sheets arranged in a stream are to be spaced apart from each other by forming a gap.

However, a web of sheets is assumed in a preferred exemplary embodiment, in which the sheets are separated from the web by cutting, tearing or the like.

It is appropriate in this case to create the gap by an interruption in the feed of the web of sheets for the separation process of the individual sheets. This is advantageously done by forming the gap by briefly interrupting the separation process.

It was found to be appropriate in this connection for the automatic sequence control to be activated by a marking of the last sheet belonging to a certain group of sheets.

The present invention seeks to achieve the most rapid transfer possible of a certain group of sheets in order to make it possible to form another stack of another group of sheets in the same area. Such conditions arise especially when individual sheets or an endless web are printed in a printer and stacks of all such documents which are intended for one recipient, e.g., invoices, remittances, bank statements or other documents, must then be formed.

According to the invention, a process for forming and transferring stacks, preferably stacks of printed sheets is provided in which the sheets are delivered in sheet groups arranged in a descending stream. Between the sheet groups a gap is located. The sheets are delivered to stop at which the stack is formed from bottom to top, wherein the stop is briefly removed from a stop position to release and remove the stack. The stack is formed using an automatic sequence control depending on the position of the gap, located between the groups of sheets. The gap is formed between the groups of sheets along a linear delivery section at a location upstream of the location in which the sheets are arranged in a stream. The sheets in the stream are formed into groups of sheets containing a predetermined number of sheets.

A "group of sheets arranged in a descending stream" is defined as a measure in which the next sheet comes to lie offset under the preceding sheet. This measure offers the advantage that the first sheet of a certain group of sheets will also come to lie in the topmost position of the stack of sheets. As a consequence of this arrangement in a descending stream, it is sufficient for the stop to project above the plane of delivery of the sheets by only a small amount, e.g., 10 to 15 mm, but by at least the thickness of one sheet, because it is only important to stop the sheets located actually at the bottom in the stack of sheets.

This leads to an advantageous embodiment of the present invention, according to which the stop may be connected to a drive member, e.g., a feed shaft, which is arranged away from the delivery section, so that it projects upward in the upright direction between the belts of a belt conveyor in its stop position and comes to lie under the delivery section in its inactive position due to rotation of the feed shaft or the like, because if the stop is moved out of the delivery section according to the present invention by rotation or displacement, the stack formed before can be transferred, i.e., removed by the continuously running conveyor. As soon as the stack moving away has gone past the position of the stop, the stop is returned into its stop position, so that the next stack can be formed within a very short time.

Slides, levers or the like may also be used instead of a feed shaft.

In an advantageous embodiment of the present invention, a discharge conveyor for the individual sheet is followed by a ramp rising obliquely above the plane of delivery of a next belt conveyor and, at a short distance behind it, by a carrier roller engaging the belt conveyor, wherein the distance between the ramp and the carrier roller is shorter than the length of the sheet extending in the direction of delivery.

Even though such an arrangement of a vamp rising obliquely has been known from Swiss Patent No. CH-PS 418 366, that patent pertains to the arrangement of sheets in a stream for subsequent folding. Stack formation is not provided in that state of the art.

Using the device according to the present invention, it is possible to arrange the sheets arriving one after the other in a stream with one another for another purpose. While the carrier roller grasps the sheet sliding over the ramp and moves it forward, the rear part of the sheet is brought by the ramp into an oblique position that makes it possible to introduce the front area of the next sheet under the rear area of the preceding page.

The separation of the individual sheet from the web of sheets may be performed in different ways. It is advantageous, e.g., for the removing conveyor to have a higher velocity than the feeding conveyor in a decollator. A pulling force is generated as a result in the web, which is able to tear off the individual sheet if a predetermined tear line is predetermined by perforation or the like. However, the individual sheet can also be separated from the web of sheets by means of a cross cutter or the like.

In another embodiment of the present invention, a web loop is provided between a web printer and the separating device for forming the sheets. This web loop has the purpose of forming a web buffer when the feed of the web is briefly interrupted to gain time for transferring a finished stack of sheets. The web printer shall not be stopped during this phase. As a consequence, the web feeder in the printer pushes the web into a loop, from which the web material is again pulled out by a temporarily rapid delivery by the discharge conveyor.

This measure is eliminated if individual printed sheets are to be stacked. A buffer, which makes possible the formation of a gap, is formed in this case from the stream section.

If a flat holding-down device is set according to the present invention against the belt conveyor in front of the stop at a distance approximately corresponding to the length of one sheet, it is possible to feed the arriving sheet with a sufficient frictional force under the stack, which may have a considerable height. Depending on the rigidity of the sheet, the stack may take up up to 3,000 sheets, because the holding-down device intensifies the friction between the sheet located under it and the belt conveyor, so that no jamming or bulging out of the sheet can occur when the sheet is being pushed under the stack.

In addition, it is expedient to bring one or more groups of balls, which extend at right angles to the direction of delivery and are rotatably mounted in sockets, into contact with the belt conveyor. These balls keep the sheets arranged in a stream one above the other in contact with the conveyors and prevent the sheets from being displaced, which is detrimental to stacking.

Finally, the present invention pertains to a measure according to which the stop and one of the conveyors for the web of sheets or for the individual sheets is/are connected to an automatic sequence control, which stops the conveyor to terminate the stack formation until a gap, which turns the stop down as soon as the last sheet has reached the stacking position, has formed between the last sheet of the stack to be formed and the next sheet.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
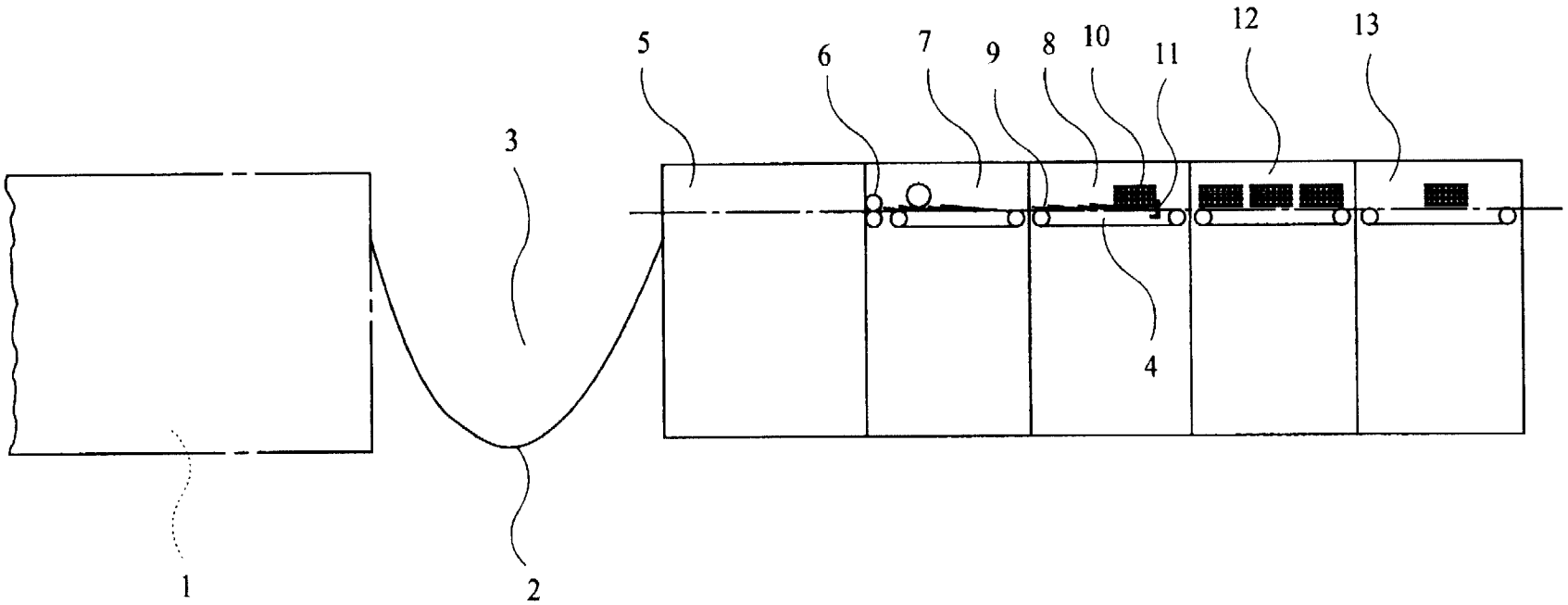
FIG. 1 is a schematic side view of a stacking device with groups arranged next to each other for printing, arranging in a stream, stacking, and transferring sheets, especially documents.

The example in FIG. 1 shows that the device suitable for carrying out the process according to the present invention may be designed as a plurality of structural units arranged one behind the other.

A web of sheets 2 provided with predetermined tear lines is printed in a printer 1. It is thus possible, e.g., to print bank statements, invoices, remittances or other documents or the like on an endless web, as a result of which the problem arises that, e.g., certain documents are to be stacked for one recipient without the risk of confusion with documents intended for other recipients.

Figures 2A, 2B:
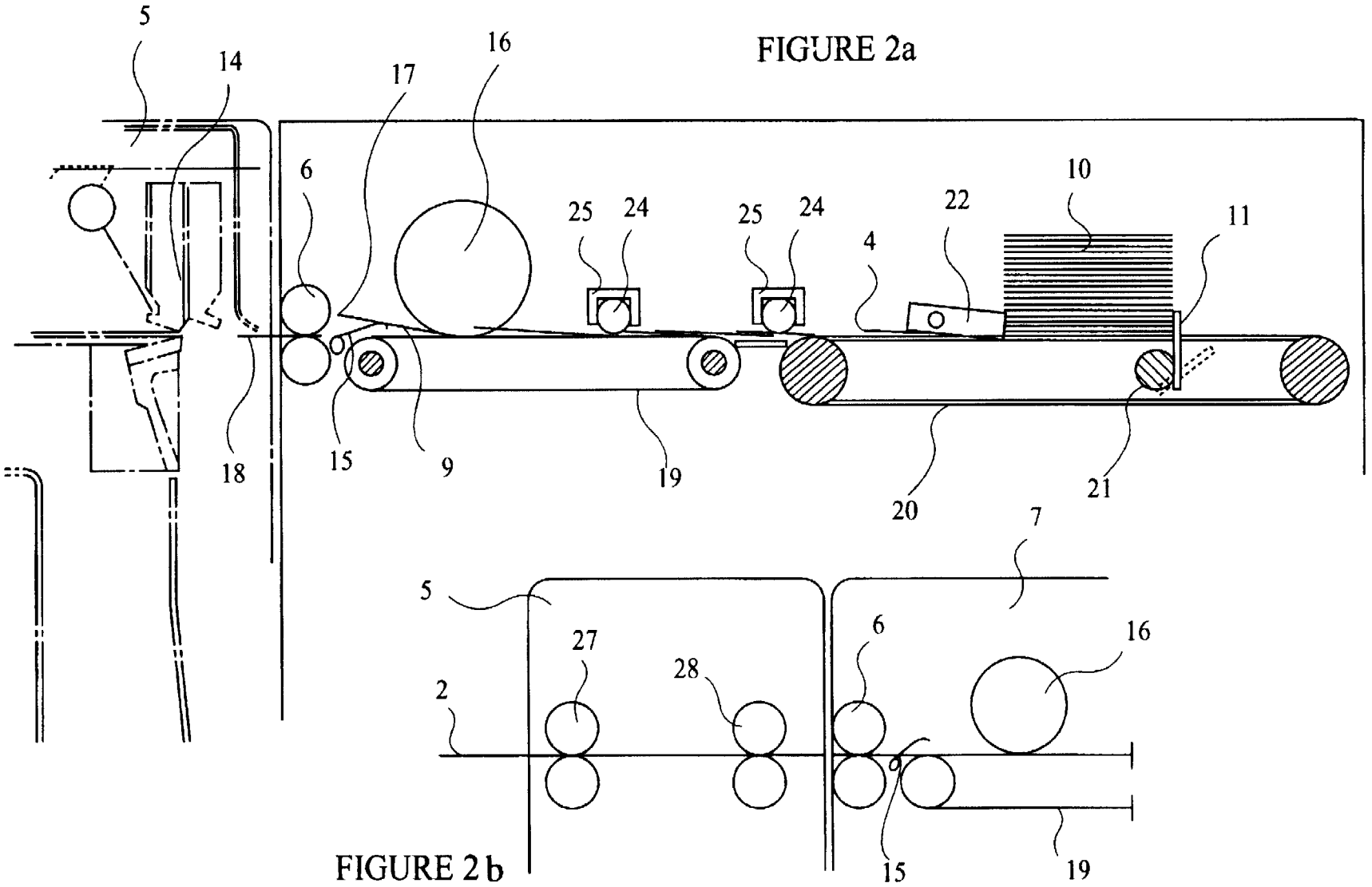
FIG. 2*a* is a schematic side view of the device for arranging sheets in a stream and stacking them on a larger scale.
FIG. 2*b* is a schematic side view of a device for separating the sheets from a web by tearing off.

The web of sheets 2 leaves the printer 1, forming a loop 3, whose significance will be described later. The web of sheets 2 then enters a separating device 5, in which it is transferred into a linear delivery section 4. The individual sheet or the individual document is separated from the endless web of sheets 2 in this separating device 5 and is taken over by a discharge conveyor device 6. This discharge conveyor device 6 delivers the separated sheet into a stream-forming device 7, whose details are shown in FIG. 2*a*. The purpose of this stream-forming device 7 is to push the next sheet under the end of the preceding sheet in order thus to ensure that each first sheet of a certain group of sheets will come to lie in the topmost position of a stack.

The sheets 9, which are thus arranged in a descending stream, are now brought together to form a stack 10, for which purpose a stop 11 is provided, which passes through the delivery section 4, e.g., in the upward direction, and with which the leading edges of the individual sheets 9 come into contact. As soon as the stack 10 of a certain group of sheets.

is finished, the stop 11 is moved out of its stop position, so that the stack 10 can be moved by the conveyor 20 (cf. FIG. 2*a*), on which the stack of sheets 10 lies during stacking. A stack buffer is designated by 12, and a stack bundling means, which is used to feed the individual stacks 10 for a further processing in the required manner, is designated by 13.

It is assumed in the example shown in FIG. 2*a* that the individual sheets 9 are separated from the web of sheets 2 by a cross cutter 14. It is expedient to stop the web of sheets 2 during the cross-cutting process, which can be achieved, e.g., by briefly stopping the drive of the cross cutter 14 with its feeding elements, not shown.

The sheets 9 are arranged in a stream according to the present invention between the discharge conveyor device 6 and the carrier roller 16, which is set against the belt conveyor 19. A ramp 15, which extends over the plane of delivery of the belt conveyor 19 in an obliquely ascending manner, is provided for this purpose. The sheet guided over this ramp 15 is therefore deflected when the front end of the sheet is grasped by the carrier roller 16. The rear area 17 of the sheet 9 is now positioned obliquely upwards, so that tile front area 18 of the next sheet is pushed under the rear area of the preceding sheet.

The sheets 9 thus arranged in a stream are first moved forward by the belt conveyor 19 and then by the belt conveyor 20. To steady the position of the sheets arranged in a stream, a plurality of balls 24, which are arranged in rows at right angles to the direction of delivery and are rotatably guided in sockets 25, are provided in the exemplary embodiment according to FIG. 2*a*. These sockets 25 have, e.g., the shape of bails, which may be designed as bails that can be pivoted up to make access to the sheets 9 arranged in a stream.

The stack 10 to be formed is obtained by a stop 11 (or a plurality of stops one behind the other) extending upward through the belt conveyor 20, assuming that the belt conveyor 20 consists of a plurality of circulating belts arranged at spaced locations from one another. The stop 11 projects out above the delivery section 4 by a short distance only, because it needs to limit the feed of only the actual lowermost sheets. A feed shaft 21, to which the stop or stops 11 is/are fastened, is located under the plane of delivery of the belt conveyor 20. By rotating this feed shaft 21, the stop 11 moves from its stop position into an inactive position, so that the stack 10 formed on the belt conveyor 20 can be transferred by the belt conveyor 20.

A holding-down device 22, which presses the continually moving belt conveyor and the sheets 9 located thereon by means of a spring, is located in front of the stop 11 at a distance corresponding to the length of one sheet. This holding-down device 22 ensures that the rear area 17 of a sheet 9 can be pushed under the stack 10 against the load of the stack 10 without crumpling.

FIG. 2*b* shows a variant of FIG. 2*b* in terms of the separation process. The separating device 5 has two pairs of pulling rollers 27 and 28, which are arranged at a spaced location from one another, and of which the pulling roller pair 27 has a lower delivery velocity than the pulling roller pair 28. The web of sheets 2 is consequently subjected between the pulling roller pairs 27, 28 to a pulling tension, which leads to the separation of the individual sheet along an existing transverse perforation.

To form sheet stacks 10 containing a certain number of sheets 9, a gap 26 must be formed between the last sheet 9 of the preceding stack 10 and the first sheet 9 of the next stack 10 (cf. FIG. 3) before the sheets 9 are arranged in a stream.

The gap formation is initiated in the example according to FIG. 2*a* by the cross cutter 5 with its drive members being briefly stopped, while the printer 1 continues to continuously operate and delivers the web 2 into the loop 3. The interruption lasts until the last sheet 9 of the preceding group of sheets can no longer be reached by the first sheet 9 of the next group of sheets on resumption of the separation process with web delivery.

In the example according to FIG. 2*b*, the pulling roller pairs 27 and 28 are stopped to form a gap 26 between tile groups of sheets. The first sheet 9 of the next group of sheets, which is already torn off, is still located in this case in the area affected by the pulling roller pair 28. However, its front edge has not yet reached the discharge conveyor 6 of the stream-forming device 7 at the time of stoppage of this sheet.

The loop 3 according to FIG. 1 is, of course, enlarged during the stoppage of the web of sheets 2 in the area of the separating device 6. To eliminate this amount of enlargement, the pulling roller pairs 26 and 27 are briefly driven at a higher delivery velocity at the end of the interruption of drive until the original normal state of operation has been reached.

The formation of a stream of sheets 9 requires the belt conveyor 19 to move more slowly than the discharge conveyor 6 or the pulling roller pair 28.

The position of the carrier roller 16 is adjustable in parallel to the direction of delivery of the sheets and can be adapted to the length of the sheet 9. The distance between the discharge conveyor 6 and the carrier roller 16 is somewhat greater, e.g., 5 mm, than the length of the sheet 9.

The distance between the pulling roller pairs 27 and 28 is also greater than the length of the sheet 9. The function of the pulling roller pair 28 would also be able to be assumed by the discharge conveyor 6.

Figure 3:
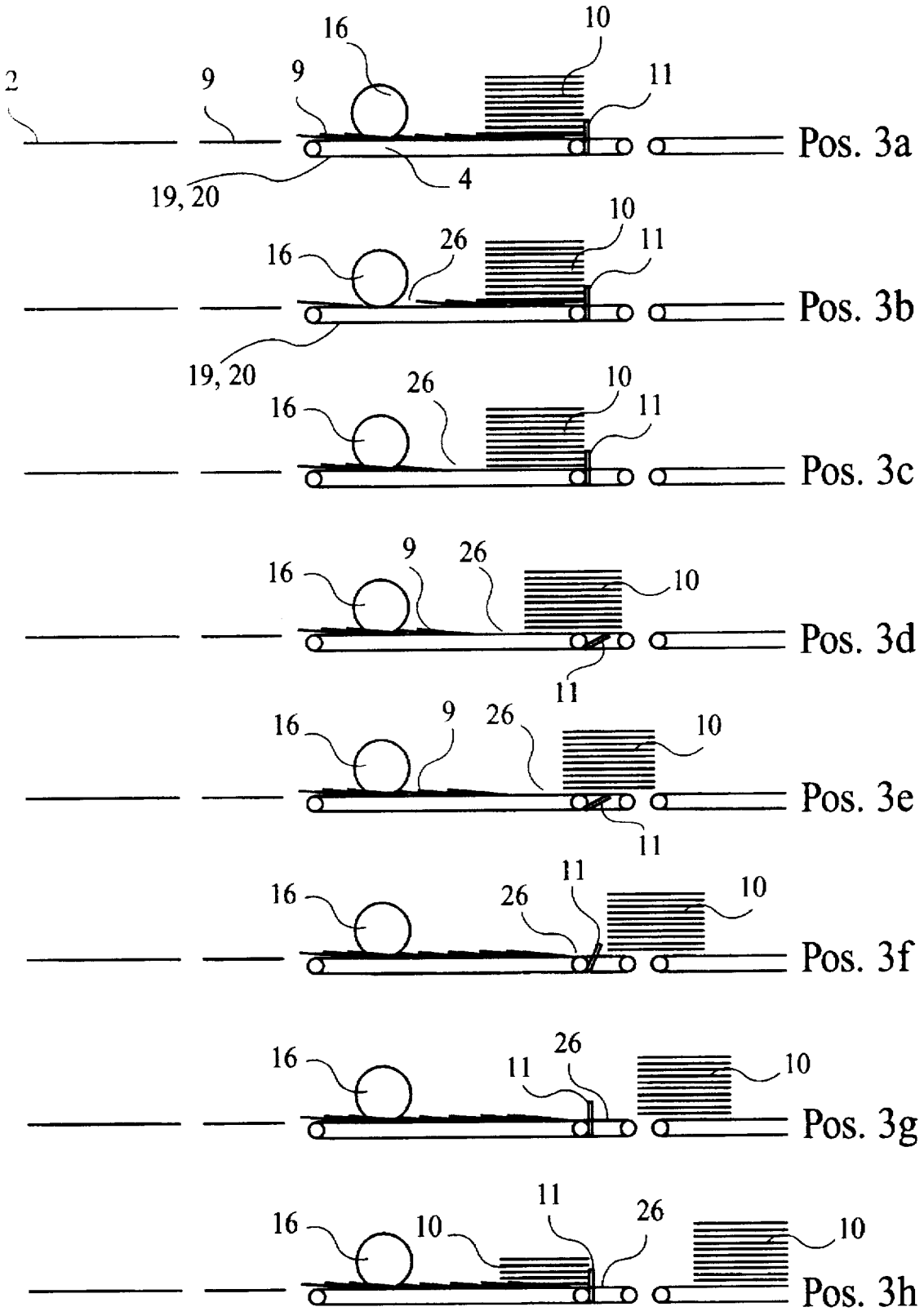
FIG. 3 is a schematic representation of the device according to FIG. 2 in different process situations.

There is a certain ratio between the movement of the stop 11 and that of the means generating a gap 26 between the sheets 9 arranged in a stream, which ratio is achieved by an automatic sequence control according to the present invention. The individual phases of this control are shown in FIG. 3 with the individual positions 3*a* through 3*h*.

It is shown in position 3*a* that an individual sheet 9 is separated from the web of sheets 2 and that the preceding sheets 9 are arranged in a stream in such a way that the following sheet 9 will always come to lie under the end of the preceding sheet 9. A stop 11, at which the stack 10 is formed, is located at the end of the delivery section 4. Reference numbers 19, 20 schematically designate a conveyor, through the upper carrying run of which the individual stop 11 passes. It is indicated in the example according to FIG. 3 that a gap 26 is formed after the control device according to the present invention has recognized that the last sheet 9 has been grasped by the carrier roller 16. The conveyor 19, 20 still delivers this last sheet 9 under the stack 10 while the separation process for the next sheet 9 is being briefly interrupted and the gap 26 is formed as a result. This gap 26 is decisive for gaining time for the transfer of the stack 10.

This phase is reached in position 3*c*. The gap 26 has moved to the stack 10, because the feed of individual sheets was briefly interrupted before, while the conveyors 19, 20 are continuously moving. It is recognized that the gap 26 is formed between the end of the stack and the front edge of the next sheet 9. If the stop 11 is now brought into the position corresponding to position 3*d*, the stack 10 can be transferred without having to stop the next sheets 9, because, as is apparent from position 3*f*, the stop 11 returns into the stop position after the passage of the stack 10, so that the gap 26 is sufficient for again stopping the leading edge of the next sheet 9 at the stop 11. This measure is indicated in position 3*g*, so that a new stack 10 can be formed corresponding to the position 3*h*.

The actuation of the stop 11 as well as the brief stopping of the separating device 6 or another conveyor for the web of sheets 2 can be initiated by a marking, e.g., a print applied to the last sheet 9 intended for a certain stack.

The arrangement according to the present invention is not limited to the use of webs of sheets 2. It is also possible to use as the starting point a stack of sheets of a greater height to pull off the individual sheets from that stack, to arrange them in a stream, and to stack them.

However, the gap 26 is always formed before the sheets 9 are arranged in a stream. This offers the advantage that sheet stacks 10 can be formed for very specific groups of sheets containing quite different numbers of sheets, because, depending on the marking on the last sheet 9 belonging to one group of sheets, the gap can be formed more easily before the stream formation process than if—as in the prior-art—the gap would have to be formed in the streamed association of the sheets.

While a specific embodiment of the invention has been shown and described in detail to illustrate the application of the principles of the invention, it will be understood that the invention may be embodied otherwise without departing from such principles.

What is claimed is:

1. A process for forming and transferring stacks such as stacks of printed sheets, comprising the steps of:

providing a linear delivery section;

forming a gap between sheets to form sheet groups along said linear delivery section, said sheet groups containing a predetermined number of sheets;

arranging said sheet groups in a stream;

delivering said sheet groups in a descending stream to a stop location;

forming a stack with an individual sheet group, from bottom to top, at said stop location, said stop location including a stop movable between a stop position and an inactive position;

moving said stop from said stop position into said inactive position and removing said stack based on use of an automatic sequence control depending on a position of said gap located between said sheet groups.

2. A process according to claim 1, further comprising providing a printed web of sheets and separating individual sheets from said printed web prior to dividing said sheets into sheet groups along said linear delivery section.

3. A process according to claim 2, wherein said gap is formed by briefly interrupting said step of separating sheets from said printed web.

4. A process according to claim 1, wherein said step of forming said gap and said step of moving said stop are performed by drive members connected to an automatic sequence control providing a non-interrupted continuous printing process.

5. A process according to claim 1, wherein said automatic sequence control is activated by a marking provided on a last sheet belonging to a sheet group.

6. A device for forming and transferring stacks of sheets, comprising:

sheet group means for forming gaps between arriving sheets for spacing apart groups of sheets containing a predetermined number of sheets arranged along a linear delivery section;

sheet stream formation means disposed at an end of said linear delivery section for arranging said groups of sheets in a descending stream;

a stop location including a stop movable between a stop position and an inactive position and stack formation means at said stop location for forming a stack of sheets from a bottom to top, said stop location and said sheet stream formation means being located downstream of said sheet group means.

7. A device according to claim 6, further comprising a printed web and a separating device for separating sheets from said printed web, said sheet group means including a control drive for briefly stopping said separating device.

8. A device according to claim 7, further comprising:

a discharge conveyor for individual sheets;

a ramp following said discharge conveyor;

a downstream belt conveyor, said ramp rising obliquely above a plane of delivery of said downstream belt conveyor; and a carrier roller, a distance between said ramp and said carrier roller being shorter than a length of sheet extending in a direction of delivery.

9. A device according to claim 8, wherein said discharge conveyor has a higher delivery velocity than a velocity of said belt conveyor.

10. A device according to claim 8, wherein said carrier roller is adjustable in parallel to a direction of delivery.

11. A device according to claim 7, wherein said separation means includes a cross cutter, said printed web including perforated sheets, said cross cutter for separating said sheets from said web.

12. A device according to claim 7, further comprising a web printer and a web loop disposed between said web printer and said separating device.

13. A device according to claim 6, further comprising a flat hold down device and a belt conveyor disposed in front of said stop, said flat hold down device being set against said belt conveyor, said belt conveyor being disposed in front of said stop at a distance approximately corresponding to a length of one of said sheets.

14. A device according to claim 8, further comprising a plurality of groups of balls extending at right angles to direction of delivery and being rotatably mounted in the sockets, said balls for contacting said belt conveyor.

15. A device according to claim 6, further comprising a discharge conveyor disposed at said linear delivery section for conveying individual sheets, said stop and said discharge conveyor being connected to automatic sequence control means for briefly stopping said discharge conveyor to terminate stack formation until a gap has formed between a last sheet of said stack to be formed and a next sheet, said automatic sequence control means being connected to said stop removing said stop from said stop position into an inactive position as soon as a last sheet of a group of sheets has reached said stacking position.

16. A process for forming and transferring a stack of sheets, the process comprising the steps of:

providing a plurality of sheets;

feeding the plurality of sheets in a non-overlapping linear progression;

forming gaps in said linear progression of sheets to divide said plurality of sheets into a plurality of predetermined groups;

arranging each of said groups into a sheet stream with a trailing edge of a downstream sheet overlapping on top of a leading edge of an adjacent upstream sheet;

moving said sheet stream to a stop location;

blocking leading edges of the sheets of said groups at said stop location to cause upstream sheets of said group to move under downstream sheets and form a stack;

unblocking said leading edges when a last sheet of said group at said stop location has entered the stack.

17. A process in accordance with claim 16, further comprising:

moving the stack away from said stop location;

again blocking sheets at said stop location after the stack has moved away from said stop location and before a leading sheet from an adjacent upstream group reaches said stop location.

18. A process in accordance with claim 16, wherein:

said unblocking is maintained during said gaps between said groups reaching said stop location.

* * * * *